US008033679B1

(12) United States Patent
Kemmler

(10) Patent No.: US 8,033,679 B1
(45) Date of Patent: Oct. 11, 2011

(54) SELF-MOUNTING SHELF WITH LIGHT

(76) Inventor: John Kemmler, Merritt Island, FL (US)

( * ) Notice: Subject to any disclaimer, the term of this patent is extended or adjusted under 35 U.S.C. 154(b) by 307 days.

(21) Appl. No.: 12/421,825

(22) Filed: Apr. 10, 2009

(51) Int. Cl.
*F21V 33/00* (2006.01)
*A47F 7/00* (2006.01)
*A47F 5/08* (2006.01)

(52) U.S. Cl. ..... 362/125; 362/133; 362/431; 211/68; 211/90.01; 108/23

(58) Field of Classification Search ..... 211/68, 211/87.01, 88.01, 90.01, 90.02, 103, 187, 211/190, 207; 108/23, 42, 48, 108, 149, 108/150, 151; 312/223.6; 362/125, 133, 362/147, 431; 248/235, 241, 250
See application file for complete search history.

(56) References Cited

U.S. PATENT DOCUMENTS 783,668 A * 2/1905 Baribeault et al. ..... 211/103
1,444,120 A * 2/1923 Helm ..... 108/23
1,554,137 A * 9/1925 Slifkin ..... 108/6
1,802,245 A * 4/1931 Foretich ..... 108/186
1,824,813 A * 9/1931 Friedemann ..... 108/108
2,037,045 A * 4/1936 Rinkhoff ..... 221/147
2,615,583 A * 10/1952 Johnson ..... 108/152
3,559,814 A * 2/1971 Downing ..... 211/135
3,865,248 A 2/1975 Donovan et al.
3,905,573 A * 9/1975 Davis ..... 248/445
4,086,858 A * 5/1978 Howitt ..... 108/110
4,667,833 A * 5/1987 Jamison ..... 211/198
4,713,734 A * 12/1987 DeKay ..... 362/147
4,862,333 A * 8/1989 Brasket ..... 362/147
5,142,460 A * 8/1992 McAtee ..... 362/249.01
5,676,261 A 10/1997 Baughman et al.
5,860,628 A * 1/1999 Miani et al. ..... 248/223.41
5,947,583 A 9/1999 Castano
6,017,131 A * 1/2000 Goins ..... 362/249.11
6,092,675 A 7/2000 Ramirez, Jr. et al.
6,267,064 B1 * 7/2001 Ostertag et al. ..... 108/50.02
7,056,007 B2 * 6/2006 Chiu ..... 362/648
D555,960 S 11/2007 Pena
2002/0085373 A1 * 7/2002 Slesinger et al. ..... 362/127
2004/0179354 A1 * 9/2004 Chen ..... 362/154
2006/0077672 A1 4/2006 Schaak
2007/0193964 A1 * 8/2007 Helms ..... 211/68
2008/0156753 A1 7/2008 Perry

* cited by examiner

*Primary Examiner* — Darnell Jayne
*Assistant Examiner* — Joshua Rodden

(57) ABSTRACT

The self-mounting shelf with a light includes a base, an overhead light, and a shelf. The base attaches to a wall or vertical surface via at least one of adhesives, nylon hook and loop strips, or mounting screws. The self-mounting shelf with a light is designed to be positioned adjacent to an electrical wall outlet in order to ensure ease of access to an electrical supply for the overhead light. The shelf may be substituted with alternate designs designed to accommodate a plurality of needs.

11 Claims, 3 Drawing Sheets

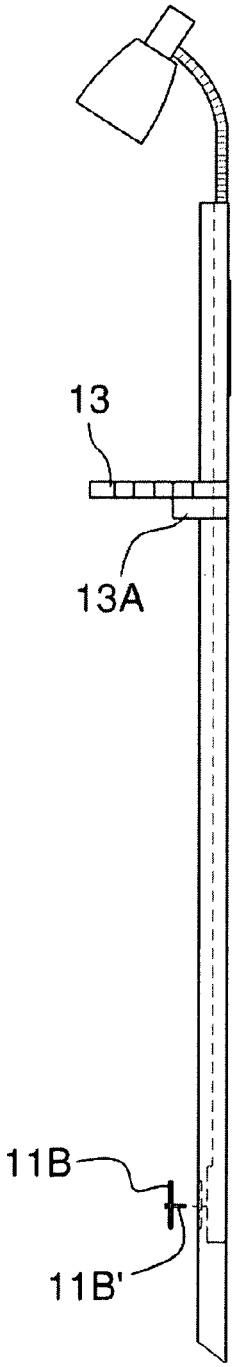
FIG. 3
FIG. 4
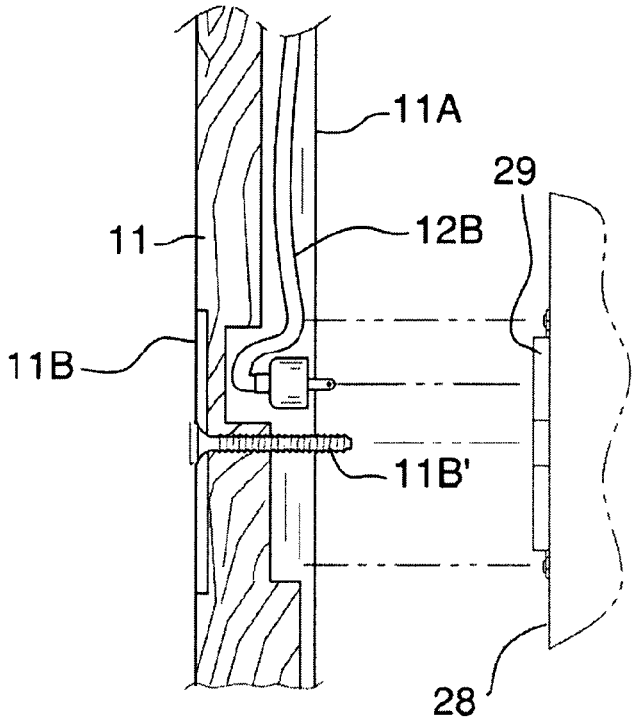
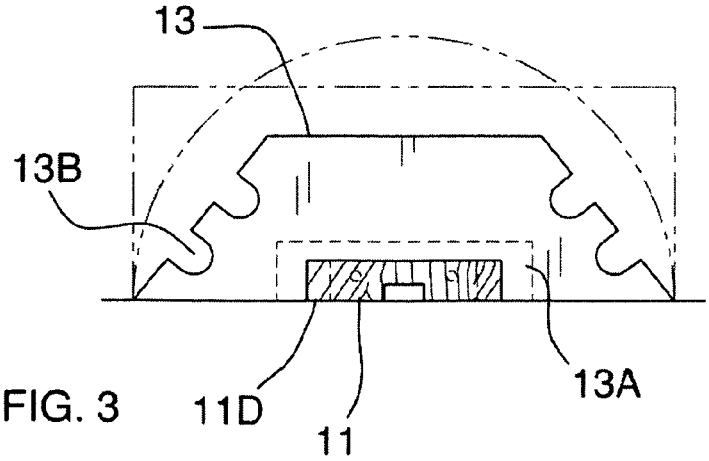
FIG. 5

SELF-MOUNTING SHELF WITH LIGHT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of shelving systems, more specifically, a self-mounting shelf that has an integrated light.

B. Discussion of the Prior Art

As a preliminary note, it should be stated that there is an ample amount of prior art that deals with shelves. As will be discussed immediately below, no prior art discloses a self-mounting shelf that has a light.

The Castano Patent (U.S. Pat. No. 5,947,583) discloses an illuminating cue stick rack made up of a rack frame and a lighting system built into or attached onto the rack frame. However, the lighting system illuminates a cue stick rack and does not provide overhead lighting of a shelf. Furthermore, the cue stick rack only supports the cue sticks when not in use and does not provide a place to rest cue sticks between turns in a pool game.

The Ramirez, Jr. et al. Patent (U.S. Pat. No. 6,092,675) discloses a pool cue holder attachment for holding pool cues to the side of a table. However, the pool cue holder does not include an overhead light and abut a wall or vertical surface.

The Schaak Patent Application Publication (U.S. Pub. No. 2006/0077672) discloses a gooseneck lighting apparatus with decorative woven sleeve. Again, the lighting apparatus does not include a self-mounting shelf.

The Donovan et al. Patent (U.S. Pat. No. 3,865,248) discloses a wall mounted billiard display system. However, the display system does not have an overhead light and pool cue rack for use while playing a game of pool.

The Baughman et al. Patent (U.S. Pat. No. 5,676,261) discloses a rotating fishing rod/pool cue holder, which supports and secures the pool cue at an angle. However, the pool cue holder does not include a shelf and overhead light and mount upon a wall or flat surface.

The Perry Patent Application Publication (U.S. Pub. No. 2008/0156753) discloses a cue holder having a base with an upper surface. However, the pool cue holder is placed upon the ground or floor and supports the pool cue at an angle, as opposed to a shelf that mounts upon the wall and includes an overhead light.

While the above-described devices fulfill their respective and particular objects and requirements, they do not describe a self-mounting shelf with light that attaches to a wall or flat surface and supports a plurality of pool cues during a pool game. In this regard, the self-mounting shelf with light departs from the conventional concepts and designs of the prior art.

SUMMARY OF THE INVENTION

The self-mounting shelf with light includes a base, overhead light, and shelf. The base attaches to a wall or vertical surface via at least one attaching means comprising adhesives, nylon hook and loop strips, or mounting screws. The invention is designed to be positioned adjacent to an electrical wall outlet in order to ensure ease of access to an electrical supply for the overhead light. The shelf may be substituted with alternate designs designed to accommodate a plurality of needs.

An object of the invention is to provide a self-mounting shelf that includes an overhead light.

A further object of the invention is to provide a shelf that can accommodate a plurality of pool cues.

A further object of the invention is to provide a place to rest a pool cue or plurality of pool cues between turns during a pool game.

These together with additional objects, features and advantages of the self-mounting shelf with light will be readily apparent to those of ordinary skill in the art upon reading the following detailed description of presently preferred, but nonetheless illustrative, embodiments of the self-mounting shelf with light when taken in conjunction with the accompanying drawings.

In this respect, before explaining the current embodiments of the self-mounting shelf with light in detail, it is to be understood that the self-mounting shelf with light is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self-mounting shelf with light. It is therefore important that the claims be regarded as including such equivalent construction insofar as they do not depart from the spirit and scope of the self-mounting shelf with light. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 3 illustrates a side view of the invention by itself detailing the mounting bracket exploded away from the base of the invention;

FIG. 4 illustrates a cross-sectional view of the invention and the mounting screw along line 4-4 in FIG. 1 detailing the power cord, channel, mounting bracket and alignment with a standard wall outlet;

FIG. 5 illustrates a cross-sectional view of the invention and alternate shelving along line 5-5 in FIG. 2 with hidden lines indicating variations in the shape of the shelf.

DETAILED DESCRIPTION OF THE EMBODIMENT

Figure 1:
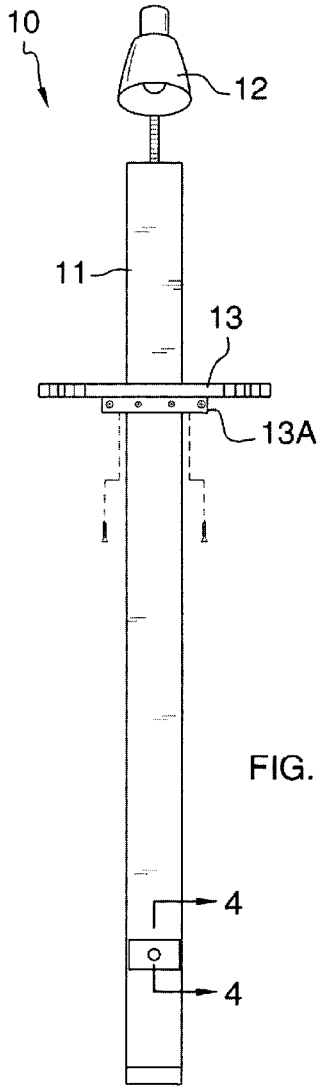
FIG. 1 illustrates a front view of the invention by itself with screws indicating attachment of the shelf to the base and hidden lines indicating the mounting bracket.
Figure 2:
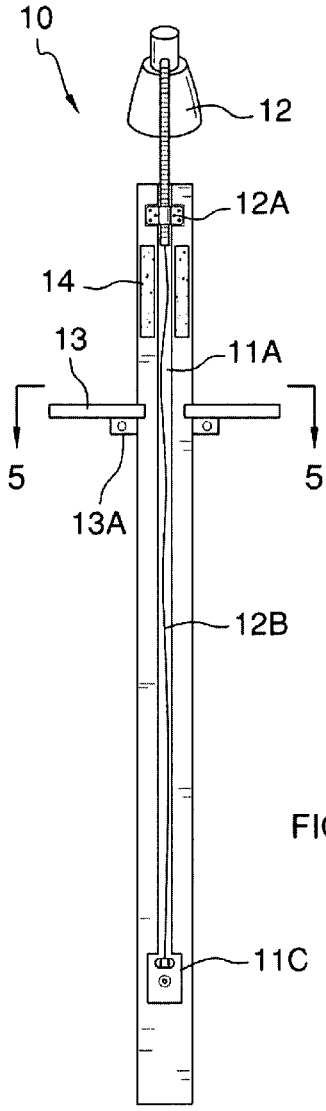
FIG. 2 illustrates a rear view of the invention by itself detailing the channel that runs down the base.

Detailed reference will now be made to the preferred embodiment of the present invention, examples of which are illustrated in FIGS. 1-6. A self-mounting shelf with light 10 (hereinafter invention) includes a base 11, a light 12, and a shelf 13.

The base 11 resembles a long, thin piece that has a channel 11A along a rear surface of the base 11. The base 11 attaches to a vertical surface via a securing means 14 comprising adhesive, nylon hook and loop strips, nailing, bolting, or screwing.

The light 12 attaches to the base 11 via a mount 12A. The mount 12A attaches to the base 11 via a notched groove that enables the mount 12A to sit flush with the outer surface of the base 11 in order to enable a flush fit of the invention 10 against a wall 28 or flat surface. The light 12 has a power cord 12B that runs the length of the base 11 via the channel 11A. Located near the bottom of the base 11 is a cavity 11C that provides room for the power cord 12B to plug into a standard wall outlet 29.

The base 11 also has a mounting bracket 11B that secures the base 11 to an electrical wall outlet 29 via a screw 11B', which also aligns the base 11 and the channel 11A to the electrical wall outlet 29 (see FIG. 4). The mounting bracket 11B screws into the electrical wall outlet 29 to secure the bottom of the base 11 to the wall 28, and to also ensure a snug fit of the power cord 12B into the standard wall outlet 29 by ensuring that the interior surface of the cavity 11C is adjacent to or pressing against the plug portion of the power cord 12B.

The mounting bracket 11B and the securing means 14 collectively ensure that the invention 10 is properly affixed to the wall 28 or flat surface.

Figure 6:
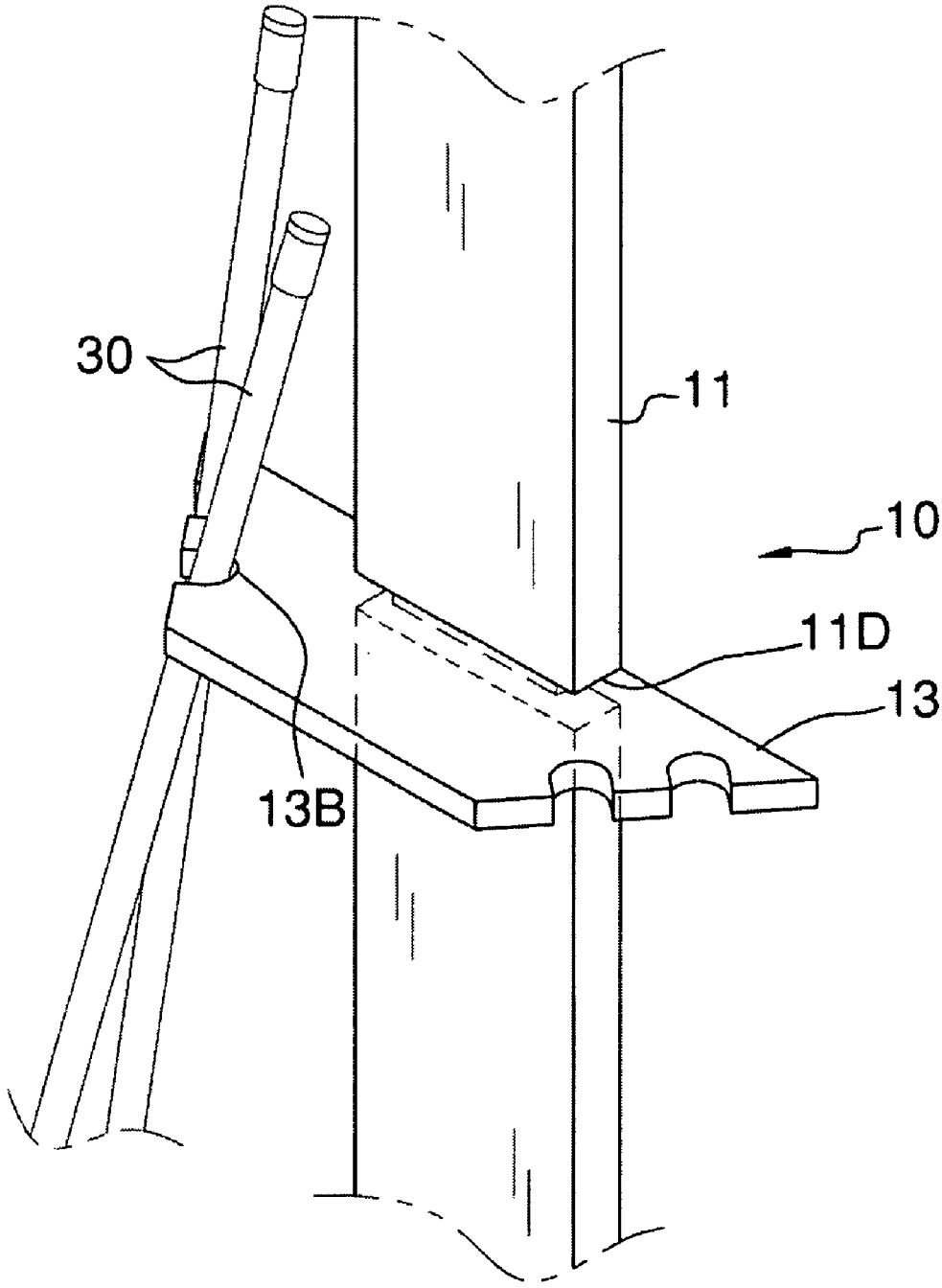
FIG. 6 illustrates an isometric view of the invention in use with a plurality of pool cues and detailing in hidden lines the notch in the base to accommodate and further support the shelf.

The shelf 13 secures itself to the base 11 via a support 13A, and a notched groove 11D in the base 11 (see FIG. 6). The shelf 13 may also have a plurality of indentations 13B in order to support a plurality of pool cues 30. However, it shall be noted that the shelf 13 may also have a semi-circular shape or rectangular shape (see FIG. 5), and provide shelving space for other uses not involving pool cues.

The base 11, the shelf 13, and the support 13A are made of a material comprising a metal, wood, or plastic. The shelf 13 and the support 13A secure to the base 11 via a means comprising adhesive, bolting, screwing, nailing, welding, or molding the two parts together.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A shelf comprising:

(a) a base;

wherein the base attaches attaches to a vertical surface via an attaching means;

(b) a light;

wherein the light attaches to the base;

wherein the base has a channel along a rear surface, which runs the length of the base and enables a power cord of the light to pass along from the location of the light to an electrical wall outlet located on the vertical surface;

wherein the base has a cavity at a bottom end of the channel that aligns with the electrical wall outlet;

wherein both the channel and cavity conceals the power cord;

wherein the base includes a mounting bracket mounted on a front surface of the base and having a mounting screw that passes through said mounting bracket and said the base and can be screwed into the electrical wall outlet in order to further secure the rear surface of the base to the vertical surface;

(c) a shelf;

wherein the shelf attaches to the base via securing means;

wherein the base has a notched groove along the front, left side, and right side that is adapted for abutting the shelf;

wherein the shelf has a plurality of indentations designed to support a plurality of pool cues.

2. The shelf as described in claim 1 wherein the base, and the shelf are made of a material comprising a wood, metal, or plastic.

3. The shelf as described in claim 1 wherein the securing means comprises adhesive, nylon hook and loop strips, nailing, bolting, or screwing.

4. The shelf as described in claim 1 wherein the shelf has a semi-circular shape.

5. The shelf as described in claim 1 wherein the shelf has a rectangular shape.

6. A shelf comprising:

a base that attaches to a vertical surface via an attaching means, and a light attached to the base and wherein the base has a channel along a rear surface, which runs the length of the base and enables a power cord of the light to pass along from the location of the light to an electrical wall outlet located on the vertical surface, and wherein the base has a cavity at a bottom end of the channel that aligns with the electrical wall outlet;

wherein the base includes a mounting bracket mounted on a front surface of the base and have a mounting screw that passes through said mounting bracket and said base and can be screwed into the electrical wall outlet in order to further secure the rear surface of the base to the vertical surface;

a shelf attaches to the base via securing means, and wherein said base has a notched groove along the front, left side, and right side that is adapted for abutting the shelf.

7. The shelf as described in clam 6 wherein the base, and the shelf are made of a material comprising a wood, metal, or plastic.

8. The shelf as described in claim 6 wherein the securing means comprises adhesive, nylon hook and loop strips, nailing, bolting, or screwing.

9. The shelf as described in claim 6 wherein the shelf has a plurality of indentations designed to support a plurality of pool cues.

10. The shelf as described in claim 6 wherein the shelf has a semi-circular shape.

11. The shelf as described in claim 6 wherein the shelf has a rectangular shape.

* * * * *